US010964465B2

(12) United States Patent
Takagi et al.

(10) Patent No.: US 10,964,465 B2
(45) Date of Patent: Mar. 30, 2021

(54) COIL DEVICE

(71) Applicant: TDK Corporation, Tokyo (JP)

(72) Inventors: Nobuo Takagi, Tokyo (JP); Kouyu Ohi, Tsuruoka (JP); Tasuku Mikogami, Tokyo (JP); Setu Tsuchida, Tsuruoka (JP)

(73) Assignee: TDK CORPORATION, Tokyo (JP)

( * ) Notice: Subject to any disclaimer, the term of this patent is extended or adjusted under 35 U.S.C. 154(b) by 22 days.

(21) Appl. No.: 16/283,641

(22) Filed: Feb. 22, 2019

(65) Prior Publication Data

US 2019/0189320 A1 Jun. 20, 2019

Related U.S. Application Data

(63) Continuation of application No. 15/282,815, filed on Sep. 30, 2016, now Pat. No. 10,256,020.

(30) Foreign Application Priority Data

Nov. 13, 2015 (JP) ..... 2015-223296

(51) Int. Cl.

| | |
|---|---|
| ***H01F 27/29*** | (2006.01) |
| ***H01F 5/04*** | (2006.01) |
| ***H01F 27/28*** | (2006.01) |
| ***H01F 27/30*** | (2006.01) |

(52) U.S. Cl.

CPC ..... *H01F 5/04* (2013.01); *H01F 27/2828* (2013.01); *H01F 27/292* (2013.01); *H01F 27/306* (2013.01)

(58) Field of Classification Search

CPC ..... H01F 5/04; H01F 27/2828; H01F 27/292; H01F 27/306; H01F 27/30; H01F 17/045

USPC ..... 336/83, 192

See application file for complete search history.

(56) References Cited

U.S. PATENT DOCUMENTS

| | | | | |
|---|---|---|---|---|
| 6,535,095 | B2 | 3/2003 | Aoki et al. | |
| 2001/0033218 | A1* | 10/2001 | Murata | H01F 17/0033 336/83 |
| 2004/0263285 | A1* | 12/2004 | Suzuki | H03H 7/427 333/181 |
| 2008/0003864 | A1* | 1/2008 | Hatakeyama | H01F 27/292 439/399 |
| 2010/0109827 | A1* | 5/2010 | Asou | H01F 41/076 336/192 |

FOREIGN PATENT DOCUMENTS

| | | | |
|---|---|---|---|
| JP | 2003017336 A | | 1/2003 |
| JP | 2013161968 A | * | 8/2013 |
| JP | 2013-191694 A | | 9/2013 |

* cited by examiner

*Primary Examiner* — Mang Tin Bik Lian
(74) *Attorney, Agent, or Firm* — Arent Fox LLP

(57) ABSTRACT

The coil device comprises the magnetic core comprising the axial part and the magnetic core end part connecting to the axial part, the coil part formed by winding the wire around the axial part, and the electrode part provided at the magnetic core end part and made of good conductor. Said electrode part comprises the fixing surface fixed with a wire end part of said wire, and the fixing surface is provided on a side surface which does not intersect with a center axis of said coil part at said magnetic core end part. Said fixing surface is inclined to a direction, away from said center axis with respect to a direction towards said magnetic core end part from said axial part.

6 Claims, 9 Drawing Sheets

COIL DEVICE

CROSS-REFERENCE TO RELATED

This application is a continuation of U.S. patent application Ser. No. 15/282,815, filed on Sep. 30, 2016, which claims priority to Japanese Patent Application No. 2015-223296, filed Nov. 13, 2015. The disclosures of the priority applications are incorporated in their entirety herein by reference.

BACKGROUND OF THE INVENTION

1. Field of the Invention

The present invention relates to a coil device used as a pulse transformer or so, and more specifically the present invention relates to the coil device suitably used for a surface mounting.

2. Description of the Related Art

Many coil devices as an inductor element and a transformer or so are mounted on various electronic electric equipment. In addition to making the size of the coil device itself compact, in order to correspond to the compact electronic devices of recent years, such coil devices are further demanded to be capable of mounting on the surface and to have good uniformity with little production variation enabling the high density mounting. As the problem to be improved from such point of view, for example the reduced surface mounting property of the coil device may be mentioned, which is caused by the formation of the alloy layer (the reaction product between the core material of the wire and the plating formed to the terminals or so) deteriorating the wettability against the solder when fixing the wire to the terminal during the coil device production steps.

As the conventional art which corresponded to such problem, the technology of forming the plurality of the surfaces having steps at the terminals are proposed thereby providing the surface to which the alloy layer can be rarely formed (see Patent document 1).

[Patent document 1] JP Patent Application Laid Open No. 2013-191694

SUMMARY OF THE INVENTION

However, in the production method of the conventional coil device, when cutting the unnecessary wire from the fixing part of the electrode to separate from the coil device, the position of cut shifts in some cases, thus this had bad influence to the uniformity of the coil devices. Also, incase of employing the cutting method by heating the wire, the position of cut may vary, thereby the alloy layer which deteriorates the wettability against the solder may extend to the terminal surface in some case.

The present invention is attained in view of such situation, and the present invention provides the coil device which can suppress the variation of the tip form of the wire and variation of the position of cut of the wire during the production, and capable of reducing the production variation and to attain the high uniformity.

In order to attain such object, the coil device of the present invention comprises a magnetic core having an axial part and a magnetic core end part connecting to said axial part, a coil part formed by winding a wire around said axial part, and an electrode part provided to said magnetic core end part and made of a good conductor, wherein said electrode part comprises a fixing surface fixed with a wire end part of said wire, and the fixing surface is provided on a side surface which does not intersect with a center axis of said coil part at said magnetic core end part, and said fixing surface is inclined to a direction away from said center axis with respect to a direction towards said magnetic core end part from said axial part.

The coil device according to the present invention comprises the fixing surface which is inclined to the direction away from the center axis, thus the position of cut of the wire can be controlled accurately. Therefore, such coil device can prevent the problem which forms the alloy layer to the unwanted part due to the reaction between the terminal surface and the core material of the wire at the tip side than the aimed position of cut since the position of cut at the wire cutting step varies. Therefore, in such coil device, the problem of the alloy layer which deteriorates the wettability of the solder is prevented from extending to the terminal surface; hence the terminal has suitable wettability against the solder, and also has good surface mounting property.

Also, for example, said wire end part may comprise the inclined tip part wherein the thickness in the perpendicular direction of said center axis becomes thinner towards the tip.

The coil devices comprising the inclined tip part can prevent the problem which occurs when cutting the wire, and the wire material which should have been cut adheres on the terminal surface as the wire material is being pulled by the wire end part. Therefore, such coil device is suitably controlled so that the alloy layer which deteriorates the wettability against the solder does not extend to the terminal surface; and thus has a good uniformity, and also the wettability against the solder of the terminal surface is suitably secured.

Also, for example, said electrode part said electrode part comprises non-fixing surface, said non-fixing surface is provided at said side surface of said magnetic core end part and at a position further away than said fixing surface with respect to said axial part, and the non-fixing surface is closer to said center axis than a fixed end to which the tip of said wire end part on said fixing surface is fixed.

The non-fixing surface is provided at the position further away than the fixing surface with respect to the heating portion of the wire which is heated when cutting the wire or fixing the wire. Therefore, by using the electrode part comprising such non-fixing surface, the wire can be easily cut at the predetermined position of the fixing surface during the production steps of the coil device. Also, even if the position of the cut of the wire is shifted, the problem that the wire end part continuing to the end surface of the coil device can be prevented, and the problem that the size accuracy of the parts varying can be prevented. Also, it is difficult to form the alloy layer on the non-fixing surface compared to the fixing surface, thus the wettability against the solder is good. Therefore, the coil device comprising such non-fixing surface comprises a good surface mounting property.

Also, for example, the coil device may comprise at least two of said electrode parts including a first electrode part and a second electrode part, said magnetic core comprises a pair of said magnetic core end part each connecting to both ends of said axial part.

at one of said magnetic core end part, said first electrode part may be provided comprising a first fixing surface as said fixing surface where one of said wire end part of said wire is fixed, at other one of said magnetic core end part, said second electrode part may be provided comprising a second fixing surface as said fixing surface where other one of said wire end part of said wire is fixed, and one of said side surface of said magnetic core end part provided with said first fixing surface and other one of said side surface of said magnetic core end part provided with said second fixing surface may be positioned on a same plane.

In such coil device, the fixing surface side of the electrode part can be used as the mounting surface, thus this is advantageous for making the electrode part and the coil device as a whole comprising the electrode part compact. Also, the problem of the alloy layer being formed on the electrode part as mentioned in the above can be prevented, thus such coil device can be suitably used for surface mounting.

Also, said electrode part may be a metal terminal fitting.

The coil device wherein the electrode part is the metal terminal fitting can be produced easily, and has good durability of the electrode part, thus such coil device has uniform and good quality.

Also, for example, said metal terminal fitting may comprise the inner side surface contacting with said side surface of said magnetic core end part, and said fixing surface may be inclined with respect to said inner side surface.

In the coil device wherein the electrode part is the metal terminal fitting comprising such inner side surface, the electrode part is suitably supported by the magnetic core end part, thus has good workability during the wire cutting step, and has good productivity and stable quality.

DESCRIPTION OF THE PREFERRED EMBODIMENTS

Hereinafter, the present invention will be described based on the embodiments shown in the figures.

Figure 1:
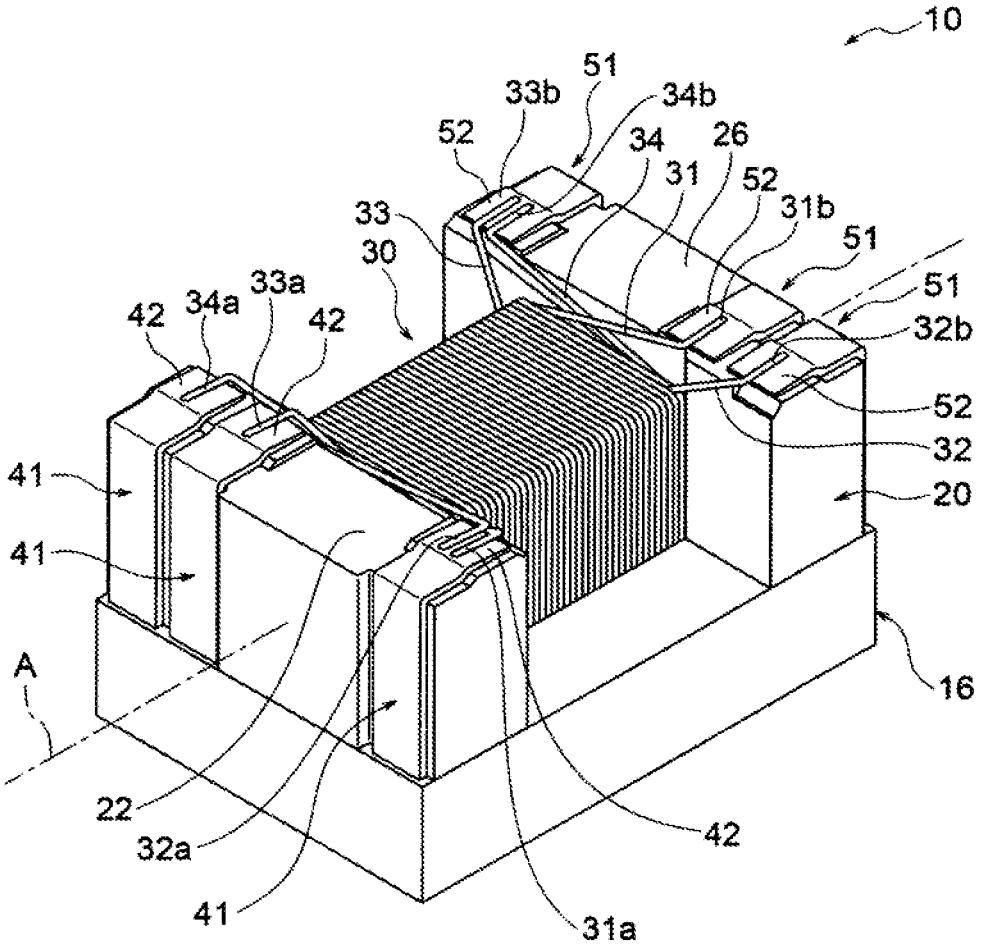
FIG. 1 is the perspective view of the coil device according to the first embodiment of the present invention.

FIG. 1 is the schematic perspective view of the coil device 10 according to the first embodiment of the present invention. The coil device 10 comprises the main body core 20 as the magnetic core, the coil part 30, and the first electrode part 41 and the second electrode part 51 as the electrode part. Also, the coil device 10 comprises a flat plate core 16 which forms the magnetic pathway together with the main body core 20. The coil device 10 described in the embodiment is a pulse transformer suitable for the surface mounting; however the coil device according to the present invention is not limited thereto, and it may be inductor element, and the transformer for the voltage converter or so. Note that, in the figure of the coil device 10, for the purpose of explaining, it is shown so that the lower side part facing the mounting substrate side when mounting is facing upwards; hence it is shown in a reversed position of the actual mounting condition.

Figure 2:
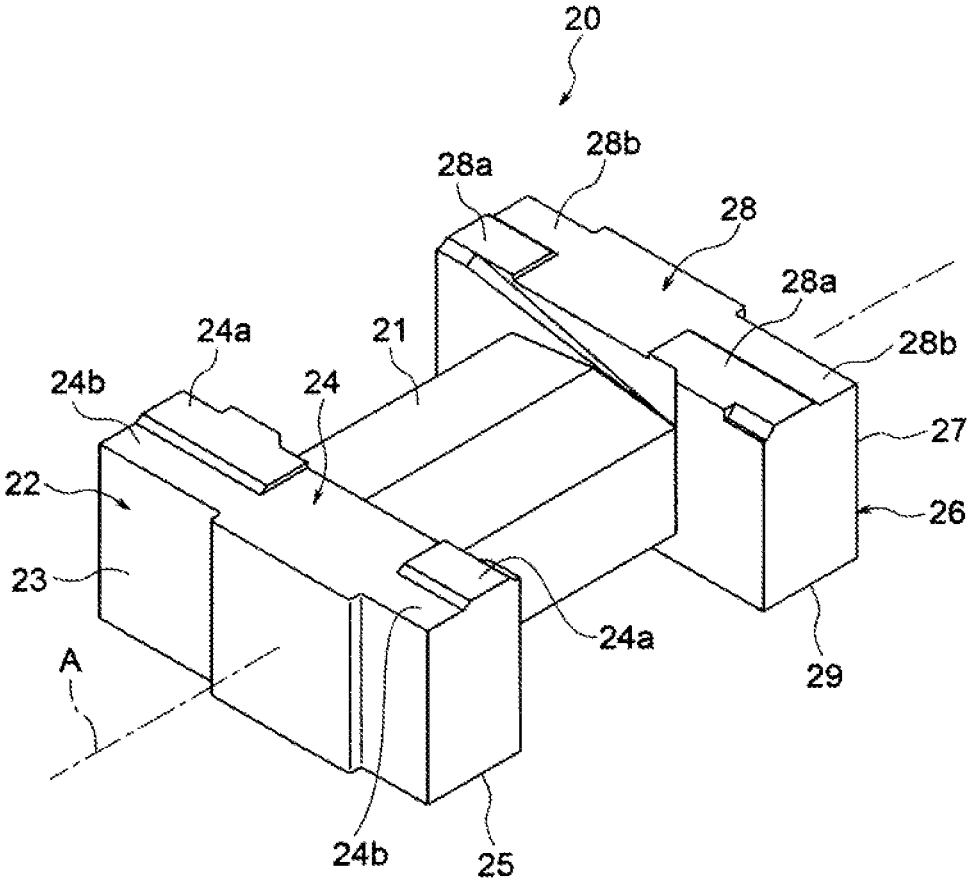
FIG. 2 is the perspective view showing the main body of the magnetic core of the coil device shown in FIG. 1.

FIG. 2 is the perspective view showing the main body core 20 of the coil device 10. The main body core 20 comprises a core part 21, and a first end part 22 and a second end part 26 as a pair of the magnetic core end part connecting with an axial part 21. The first end part 22 and the second end part 26 respectively connects with the both end part of the axial part 21, and the main body core 20 constitutes the drum shape core.

The first end part 22 comprises a lower side surface 24 facing towards the mounting surface side, the upper side surface 25 which is the surface of opposite side of the lower side surface 24, the surface connecting with the axial part 21, and the end surface 23 which is the surface of opposite side of the surface connecting with the axial part 21; and the first end part 22 has the outer shape of approximately rectangular parallelepiped shape. The lower side surface 24 and the upper side surface 25 are the surface which does not intersect with the center axis A of the coil part 30, and the end surface 23 is the surface which intersects with the center axis A. At the lower side surface 24, the projected surface 24*a* which comprises as step and the depressed surface 24*b* are formed. The lower side surface 24 is the surface where the first fixing surface 42 of the first electrode part 41 which will be described in following is provided. Further specifically, the first fixing surface 42 is provided to the projected surface 24*a* projecting to the direction away from the center axis A in the lower side surface 24 (see FIG. 1 and FIG. 3). The depressed surface 24*b* is depressed towards the center axis A side than the projected surface 24*a*, and the distance between the depressed surface 24*b* and the upper side surface 25 which is the surface of the opposite side is closer than the distance between the projection surface 24*a* and the upper side surface 25.

As shown in FIG. 2, the second end part 26 has the outer shape of approximately rectangular parallelepiped shape which is symmetric with respect to the first end part 22. As similar to the first end part 22, the second end part 26 comprises the lower side surface 28 facing towards the mounting surface side, the upper side surface 29 which is the surface of opposite side of the lower side surface 28, and the end surface 27 or so. The lower side surface 28 and the upper side surface 29 are the surfaces which do not intersect with the center axis A of the coil part 30, and the end surface 27 is the surface intersecting the center axis A. The lower side surface 28 of the second end part 26 is the surface which is provided with the second fixing surface 52 of the second electrode part 51. Further specifically, the second fixing surface 52 is provided to the projected surface 28*a* among the lower side surface 28. The depressed surface 28*b* is depressed towards the center axis A side than the projected surface 28*a*, and the distance between the depressed surface 28*b* and the upper side surface 29 which is the surface of the opposite side is closer than the distance between the projected surface 28*a* and the upper side surface 29.

The upper side surface 25 of the first end part 22 and the upper side surface 29 of the second end part 26 are both flat surfaces, and positioned on the same plane. As shown in FIG. 1, the flat plate core 16 has the rectangular parallelepiped shape, and it is fixed to the upper side surface 25 of the first end part 22 and the upper side surface 29 of the second end part 26. In the coil device 10, the closed magnetic circuit looping between the flat plate core 16 and the main body core 20 is formed. Depending on the use of the coil device 10, a gap may be provided between the flat plate core 16 and the main body core 20, and also the coil device 10 may be an embodiment which does not use the flat plate core 16.

The main body core 20 and the flat plate core 16 are constituted by a sintered article or a molded article of the magnetic material including Ni—Zn based ferrite, Mn—Zn based ferrite, or magnetic metal. The main body core 20 and the flat plate core 16 can be bonded for example by the adhesive agent or so. Note that, when surface mounting the coil device 10, the outer side surface of the flat plate core 16 (the opposite surface of the surface bonded with the main body core 20) is suctioned by the suction arm of the mourning device; thereby the coil device 10 is transferred to the mounting position.

As shown in FIG. 1, the coil part 30 is formed by winding the wires 31, 32, 33, and 34 around the axial part 21 (see FIG. 3) of the main body core 20. The coil part 30 of the coil device 10 is constituted by four wires 31, 32, 33 and 34; however the number of wires included in the coil part 30 is not particularly limited. The wire first end parts 31*a*, 32*a*, 33*a*, 34*a* which are one end of the wire end part of each wire 31, 32, 33, 34 are pulled out to the first end part 22 side of the main body core 20 from the part winding around the axial part 21, then fixed to the first electrode part 41. Also, the wire second end parts 31*b*, 32*b*, 33*b*, 34*b* which are one end of the wire end part of each wire 31, 32, 33, 34 are pulled out to the second end part 26 side of the main body core 20 from the part winding around the axial part 21, then fixed to the second electrode part 51.

The wires 31, 32, 33 and 34 are constituted for example by a coated conductive wire, and have a structure wherein the tore material made of the good conductor is coated by the insulation coating. The diameter of the wires 31 to 34 are not particularly limited, however preferably it is 0.02 to 0.1 mm. The wires 31 to 34 are wound in a four layer structure around the axial part 21, and the center axis A of the coil part 30 constituted by the wires 31 to 34 approximately matches with the center axis of the axial part 21 of the main body core 20. The number of winding of the wires 31 to 34 may be changed appropriately depending on the demanded characteristic of the coil device 10, and each wire 31 to 34 may be tightly wound around the axial part 21 as shown in FIG. 1, or may be wound by placing a space in some part.

As shown in FIG. 1, the coil device 10 comprises at least two electrode parts which includes the first electrode part 41 provided to the first end part 22 of the main body core 20, and the second electrode part 51 provided to the second end part 26 of the main body core 20. The core device 10 comprises three first electrode parts 41 and three second electrode parts 51, that is total of six electrode parts, however the number of the electrode parts comprised by the coil device 10 can be appropriately changed depending on the function and the use of the coil device 10, and also by the number of wire or so.

The first electrode part 41 comprises the first fixing surface 42 to which at least one of the wire first end part 31*a*, 32*a*, 33*a*, 34*a* of one of the wire end part of the wires 31, 32, 33, 34 are fixed. As shown in FIG. 1A, the wire first end parts 31*a* and 32*a* are fixed to the common first fixing surface 42 of the first electrode part 41; and as for the wire first end parts 33*a* and 34*a*, each of first end parts 33*a* and 34*a* are fixed to one first fixing surface 42 of the first electrode part 41. In the coil device 10, the shape of three of the first electrode parts 41 are the same, hence the first electrode part 41 fixed with the wire first end part 32*a* (and the wire first end part 31*a*) will be explained, and for other first electrode parts 41 will be omitted from explaining. Note that, the first electrode part 41 may have different shape such as a width or so against each other depending on the number or so of the wire first end parts 31*a* to 34*a* to be fixed.

Figure 3:
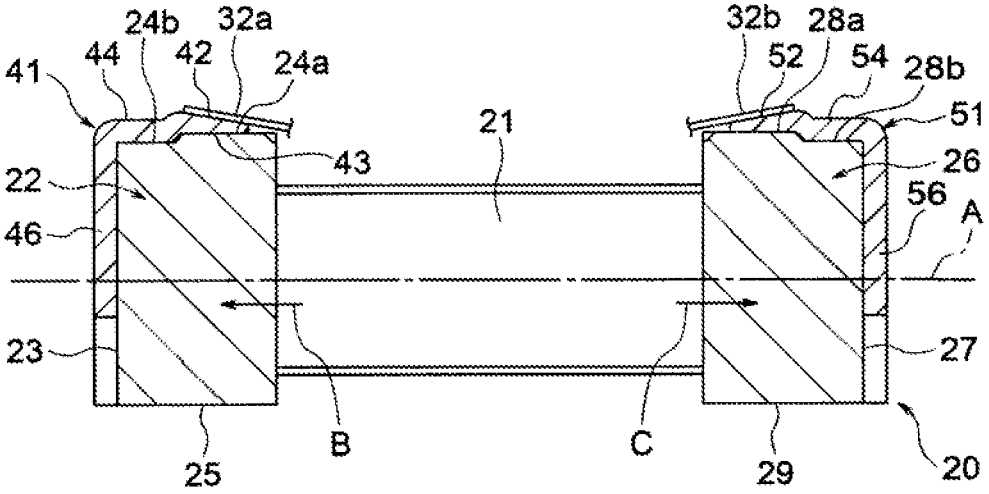
FIG. 3 is the cross section of the coil device shown in FIG. 1.

The first fixing surface 42 fixed with the wire first end parts 31*a* and 34*a* is provided at the projected surface 24*a* of the lower side surface 24 of the first end part 22 shown in FIG. 2. FIG. 3 is the cross section view of the coil device 10 at the cross section which is perpendicular to the upper side surfaces 25 and 29 of the first end part 22 and the second end part 26, and also passing through the first electrode part 41 and the second electrode part 51. Note that, in FIG. 3, the coil part 30 and the flat plate core 16 are not shown except for the wire end parts 32*a* and 32*b*.

As shown in FIG. 3, the projected surface 24*a* and the depressed surface 24*b* of the lower side surface 24 provided with the first fixing surface 42 are the surface extending in the parallel direction to the center axis A. However, on the contrary to the projected surface 24*a* and the depressed surface 24*b* which are the surface extending in the parallel direction to the center axis A, the first fixing surface 42 is not parallel to the center axis A in regards with the direction B towards the first end part 22 from the axial part 21, and the first fixing surface is inclined.

Figure 4:
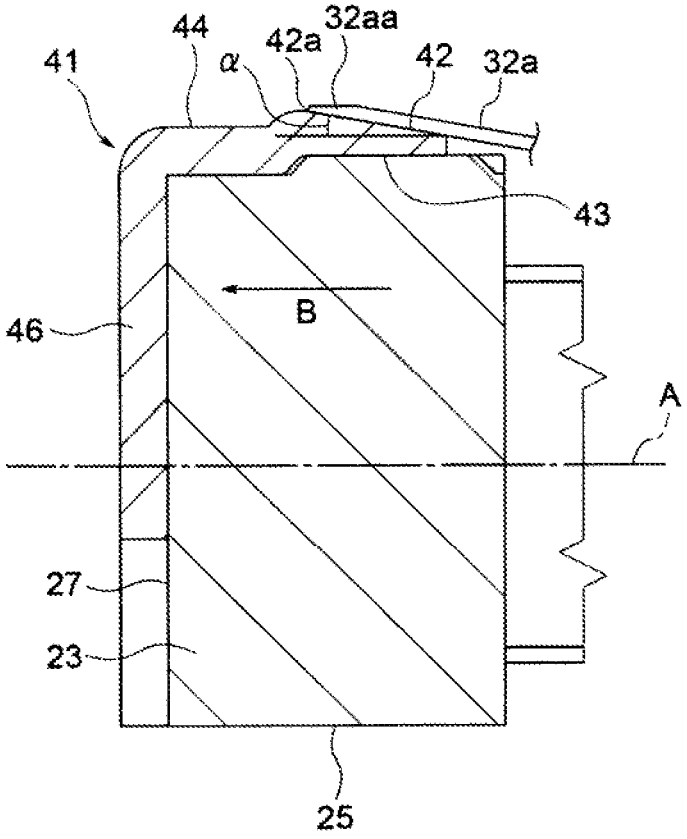
FIG. 4 is the enlarged cross section of which the surrounding of the electrode part of the coil device shown in FIG. 1 is enlarged.

FIG. 4 is the enlarged cross section view of which the surrounding of the first electrode part 41 of FIG. 3 is enlarged. The first fixing surface 42 shown in FIG. 4 is inclined to the direction away from the center axis A with respect to the direction B towards the first end part 22 from the axial part 21. The angle of inclination $\alpha$ of the first fixing surface 42 is not particularly limited as long as it is larger than 0 degrees and smaller than 90 degrees; however preferably it is 3 to 20 degrees from the point of enhancing the uniformity of the shape of the wire first end part 32*a*.

Also, as shown in FIG. 4, the wire first end part 32*a* fixed to the first fixing surface 42 preferably comprises the inclined tip part 32*aa* which the thickness of the perpendicular direction to the center axis A becomes thinner towards the tip. Note that, for the effect of the inclined tip part 32*aa*, it will be explained in below together with the method of fixing the wire 32.

Also, the first electrode part 41 comprises the non-fixing surface 44 provided at the lower side surface 24 of the first end part 22, and at the position further away from the axial part 21 compared to the first fixing surface 42. The non-fixing surface 44 is closer to the center axis A and the upper side surface 25 compared to the distance between the center axis and the upper side surface 25 and the fixing end 42*a* where the tip of the wire first end part 32*a* is fixed in the first fixing surface 42. It is difficult to form the alloy layer formed by the reaction between the plating layer or so of the first electrode part 41 and the core material of the wire 32 on such non-fixing surface 44 when fixing the wire 32, and thus the wettability against the solder is good.

The first electrode part 41 is the metal terminal fitting having a "L" shaped form, and the extension part 46 of the first electrode part 41 is fixed to the end surface 23 of the first end part 22 by adhesive material. The first electrode part 41 constituted by the metal terminal has higher durability compared to the electrode part constituted by the printing layer or the plating layer formed on the core, main body. Also, the first electrode part 41 has only a little risk of breaking during the forming step of the wire end part which will be described in below, thus has good workability.

As shown in FIG. 1, the second electrode part 51 comprises the second fixing surface 52 to which at least one of the wire second end part 31*b*, 32*b*, 33*b*, 34*b* of the wire 31, 32, 33, 34 are fixed. The wire second end parts 33*b* and 34*b* are fixed to the second fixing surface 52 of the common second electrode part 51; and for the wire second end parts 31*b* and 32*b*, each one of the wire second end part 31*b* and 32*b* are fixed to the second fixing surface 52 of one second electrode part 51. The three of the second electrode parts 51 have the same shape, hence the second electrode part 51 fixed with the wire second end part 32*b* will be explained, and for other second electrode parts, it will be omitted from explaining. Also, for the explanation of the second electrode part 51, the common portions as the second electrode part 41 will be omitted from explaining.

The second fixing surface 52 fixed with the wire second end part 32*b* is provided to the projected surface 28*a* of the lower side surface 28 of the second end part 26 shown in FIG. 2. As shown in FIG. 3, the second fixing surface 52 is inclined in the direction away from the center axis A with respect to the direction C to the second end part 26 from the axial part 21. The angle of the inclination of the second fixing surface 52 is as the same as the tangle of the inclination $\alpha$ of the fixing surface 42 (see FIG. 4). Also, the wire second end part 32*b* fixed to the second fixing surface 52 preferably comprises the inclined tip part wherein the thickness in the perpendicular direction of the center axis A becomes thinner towards the tip, as similar to the wire first end part 32*a* fixed to the first fixing surface 42.

Further, as similar to the first electrode part 41, the second electrode part 51 comprises the non-fixing surface 54 provided at the lower side surface 28 of the second end part 26, and at the position further away than the axial part 21 compared to the second fixing surface 52. The second, electrode part 51 is the metal terminal fitting of a "L" shaped form as similar to the first electrode part 41, and the extension part 56 of the second electrode part 51 is fixed to the end surface 27 of the second end part 26 using the adhesive material or so.

The first electrode part 41 and the second electrode part 51 may be formed by bending or by carrying out the surface plating such as Ni and Sn or so to the metal plate or the alloy plate; however the first electrode part 41 and the second electrode part 51 are not particularly limited as long as it is constituted by the good conductor.

Hereinafter, an example of the production method of the coil device 10 will be explained. In the production of the coil device 10, first the main body core 20 obtained by molding the magnetic powder of the soft magnetic material is fixed to the first electrode part 41 and the second electrode part 51. As shown in FIG. 3, the first electrode part 41 and the second electrode 51 are fixed by adhering the extension parts 46 and 56 to the end surfaces 23 and 27 of the first end part 22 and the second end part 26. Here, the adhesive agent is not coated to the lower side surfaces 24 and 28 of the first end part 22 and the second end part 26; and the projected surfaces 24*a* and 28*a* and the depressed surfaces 24*b* and 28*b* are not adhered to the first electrode part 41 and the second electrode part 51. Thereby, the problem of varying the distance from the lower side surfaces 24 and 28 to the fixing surfaces 42 and 52 of the first and second electrode parts 41 and 51, or to the non-fixing surfaces 44 and 45 can be prevented, wherein such problem is caused by the thickness of the adhesive agent cured layer varying which is formed by curing the adhesive agent.

Next, the wire material which is the material of the first to fourth wires 31 to 34 are wound around the axial part 21 of the main body core 20, then the both end parts are respectively fixed to the first electrode part 41 and the second electrode part 51 followed by cutting the extra part, thereby the wire end parts 31*a* to 34*a* and 31*b* to 34*b* are formed (see FIG. 3). For the wire material as the material of the first to fourth wires, for example the core material made of good conductor such as copper (Cu) is coated with the insulating material made of imide modified polyurethane or so, and further coating the outer most surface with the thin resin coating of polyester or so can used.

Figure 5A:
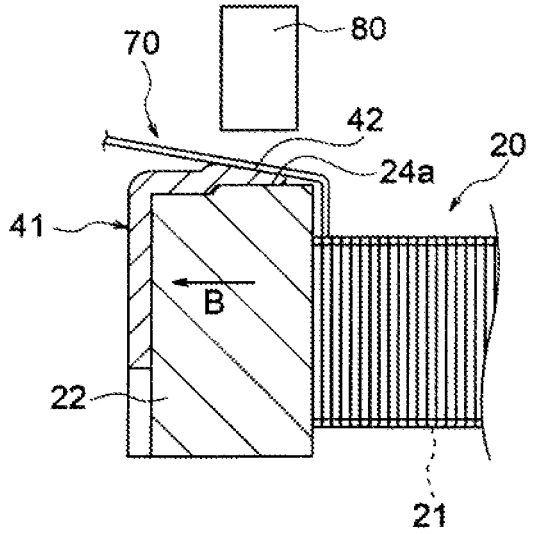
FIG. 5A is the conceptual figure showing the forming step of the wire end part.
Figure 5B:
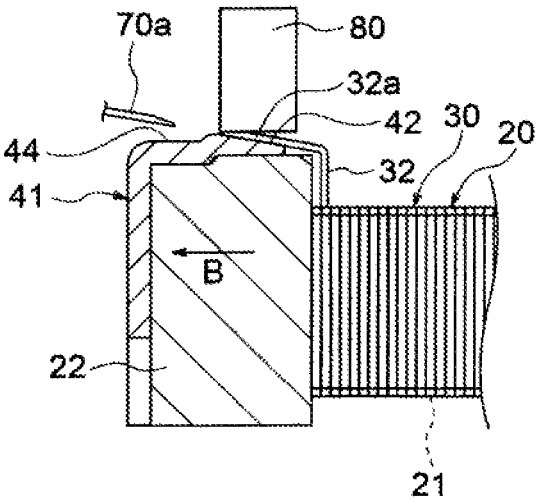
FIG. 5B is the conceptual figure showing the forming step of the wire end part.

FIG. 5 is the conceptual figure explaining the forming step of the wire first end part 32*a*. Note that, the method of forming other wire first end parts 31*a*, 33*a*, and 34*a* are the same as the wire first end part 32*a*. As shown in FIG. 5(*a*), the wire material 70 which is the material of the wire 32 is wound around the axial part 21 of the main body core 20, and then it is pulled out to the direction B towards the first end part 22 from the axial part 21. Here, the wire material 70 is pulled out along the first fixing surface 42 of the first electrode part 41 thereby the first fixing surface 42 is in contact with part of the wire material 70. Note that, the end part of the wire material 70 is pulled to the direction 13 in a predetermined tensile force.

Next, as shown in FIG. 5(*b*), the heater chip 80 is moved closer to the first fixing surface 42 of the first electrode part 41, and the wire material 70 is placed between the heater chip 80 and the first fixing surface 42. Further, by pressing the heater chip 80 towards the first fixing surface 42, part of the wire material 70 is melted and bonded to the first fixing surface 42. At this time, the core material (Cu) of the wire material 70 and the plate coating (Ni and Sn) of the terminal surface are formed into alloy, thus the alloy layer is formed at the boundary area between the wire and the electrode part, thereby a sufficient bonding force is obtained. Further, by moving the heater chip 80 and by promoting the heating of the wire material 70, the wire material 70 placed between the heater chip 80 and the fixing surface 42 are cut, thereby the wire first end part 32*a* is formed. After the cut, the extra part 70*a* from the wire first end part 31*a* is released in the extending direction of the first fixing surface 42 using the tensile force. Note that, such bonding and cutting method is good because the bonding and cutting can be done in one step, and it is particularly advantageous when the wire diameter of the wires 31 to 34 is small.

Figure 6:
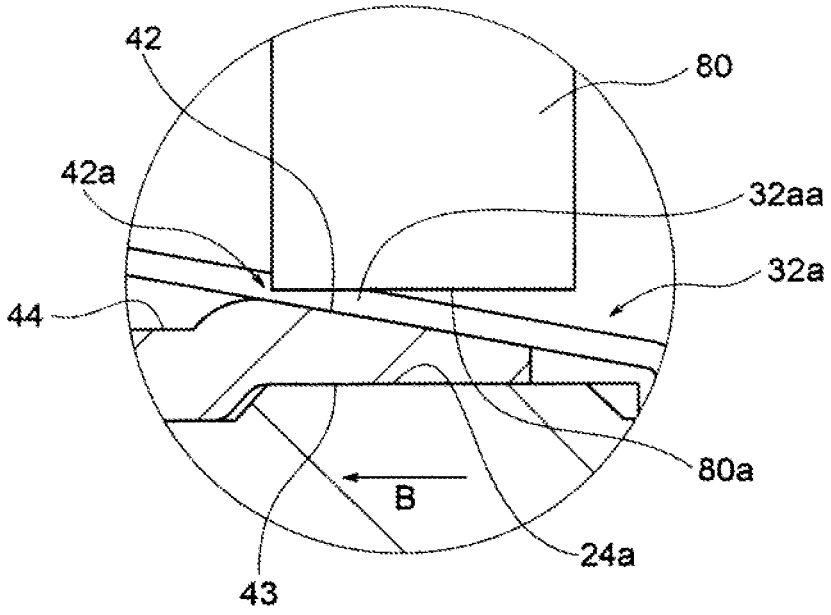
FIG. 6 is the schematic enlarged view of which the surrounding of the positon of cut of the wire material during the forming step of the wire end part is enlarged.

FIG. 6 is the enlarged view showing the condition when cutting the wire material 70 by heater chip 80. During the step of forming the wire first end part 32*a* mentioned in the above, while the lower surface 80*a* of the heater chip 80 is held approximately parallel with the lower side surface 24, particularly with the projected surface 24*a* of the first end part 22, the heater chip 80 is approached closer to the first fixing surface 42 of the first electrode part 41. Here, the first fixing surface 42 is inclined with respect to the center axis A and the projected surface 24*a*, hence the space between the first fixing surface 42 and the lower surface 80*a* of the heater chip 80 forms the wedged shape. Therefore, the wire first end part 32*a* formed by fixing between the first fixing surface 42 and the lower surface 80*a* of the heater chip 80 has the inclined tip part 32*aa* wherein The thickness in the perpendicular direction of the center axis A become thinner towards the tip. Since the wire first end part 32*a* comprises the inclined tip part 32*aa*, the shape of the wire first end part 32*a* and the area of the alloy layer formed around the wire first end part 32*a* can be unified.

Also, the first fixing surface 42 is inclined to the direction away from the center axis A that is the direction towards the lower surface 80*a* of the heater chip 80. Therefore, the wire material 70 is accurately cut near the end part of the lower surface 80*a* which is further away from the axial part 21, thus the position of the fixing end 42*a* can be prevented from varying. Also, since the position of the fixing end 42*a* can be accurately determined, the problem wherein the alloy layer extending to the non fixing surface 44 having a step with respect to the first fixing surface 42 can be securely prevented. Further, as shown in FIG. 5(*b*), immediately after cutting the wire material 70, the extra portion 70*a* from the wire end part 32*a* will be released to the direction at from the center axis A, thus the extra portion 70*a* is prevented from adhering to the non-fixing surface 44.

Note that, as shown in FIG. 6, the first fixing surface 42 of the first electrode part 41 is inclined with respect to the inner side surface 43 contacting with the projected surface 24*a* of the lower side surface 24 of the first end part 22, and preferably the inner side surface 43 is parallel with the projected surface 24*a* and the lower side surface 24. The inner side surface 43 is parallel with the projected surface 24, thus the first fixing surface 42 is stably supported by the projected surface 24*a*, thereby the workability when forming the wire first end part 32*a* is improved and also the plastic deformation of the first electrode 41 can be prevented, hence the accuracy of the shape can be improved.

The wire second end parts 31*b* to 34*b* shown in FIG. 1 are similarly formed as the wire end part 32*a* which has been described using FIG. 5 and FIG. 6. Lastly, the flat plate core 16 is fixed to the main body core 20 formed with the first electrode part 41, the second electrode part 51 and the coil part 30 thereby the coil device 10 is obtained.

In the coil device 10 as discussed in the above, the first and second fixing surfaces 42 and 52 to which the wire end parts 31*a* to 34*a* and 31*b* to 34*b* are fixed is inclined to the direction away from the center axis A with respect to the direction towards the first end part 22 and the second end part 26 from the axial part 21. Thereby, the position of cut during the wire cutting step, and the shape of the wire end parts 31*a* to 34*a* and 31*b* to 34*b* can be prevented from varying, thus the coil device 10 has the highly accurate outer shape with low production variation, and has stable quality.

Also, if the position of cut varies during the wire cutting step, the alloy layer is excessively formed which is made from the reaction between the core material of the wires 31 to 34 and the plating layers of the first and the second electrode parts 41 and 51, thus there is a risk of deteriorating the wettability against the solder of the first and the second electrode parts 41 and 51. However, the coil device 10 can highly accurately control the shape of the position of the cut of the wire material 70 and the wire end parts 31*a* to 34*a* and 31*b* to 34*b*, hence the alloy layer is prevented from being formed excessively, thus good wettability against the solder of the first and the second electrode parts 41 and 51 can be maintained. Therefore, the coil 10 exhibits good mounting property.

Also, in the coil device 10, the projected surface 24*a* of the lower side surface 24 of the first end part 22 provided with the first fixing surface 42, and the projected surface 28*a* of the lower side surface 28 of the second end part 26 provided with the second fixing surface 52 are positioned on the same plane. Therefore, the coil device 10 can use the side where the first fixing surface 42 and the second fixing surface 52 are provided as the mounting surface when mounting on the substrate or so. Even in case the coil device 10 uses the side provided with the first fixing surface 42 and the second fixing surface 52 as the mounting surface, the wettability against the solder of the first and the second electrode parts 41 and 51 can be maintained in good condition, and exhibits a good mounting property. Also, when the first fixing surface 42 and the second fixing surface 52 comprises the non-fixing surfaces 44 and 45 as shown in FIG. 3, it is particularly preferable when the side of the first fixing surface 42 and the second fixing surface 52 is used as the mounting surface. In such case, the non-fixing surfaces 44 and 54 contributes to the formation of a good solder fillet which is between the land of the mounting substrate and the first and second electrode parts 41 and 51.

As mentioned in above, the present invention has been described using the coil device 10 according to the embodiments; however the present invention is not to be limited to the aforementioned embodiments, and obviously comprises many other embodiments and modified examples as well.

Figure 7:
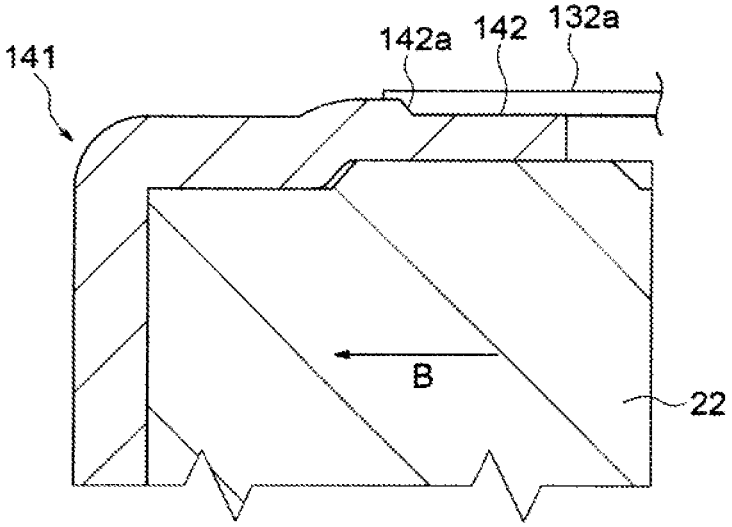
FIG. 7 is the enlarged cross section of which the surrounding of the electrode part of the coil device according to the first modified example is enlarged.

FIG. 7 is the cross section showing the first electrode part 141 included in the coil device according to the first modified example. The first end part 22 of the main body core 20 comprises the first fixing surface 142 fixed with the wire first end part 132*a*, and a part 142*a* of the first fixing surface 142 is inclined to the direction further way from the center axis with respect to the direction B towards the first end part 22 from the axial part 21. As such, the embodiment wherein a part 142*a* of the first fixing surface 142 (or the second electrode part) is inclined, the position of cut of the wire material and the shape of the wire end part can be controlled accurately. Note that, preferably at least the position of the fixed end 42*a* is inclined, and further preferably the first fixing surface 142 as a whole is inclined.

Figure 8:
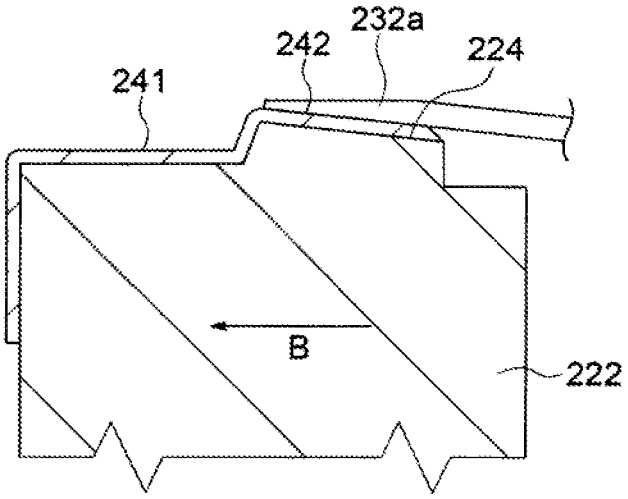
FIG. 8 is the enlarged cross section of which the surrounding of the electrode part of the coil device according to the second modified example is enlarged.

FIG. 8 is the cross section showing the first electrode part 241 included in the coil device according to second modified example. The first electrode part 241 of FIG. 8 is formed at the first end part 222 of the main body core and by the plating layer. The plating layer an be formed by an electroless plating or so, however the method of forming the plating layer is not particularly limited. The first electrode part 241 formed by the plating comprises the first fixing surface 242 fixed with the wire first end part 232*a*, and inclined to the direction away from the center axis with respect to the direction B. As such, even in case the first electrode part 241 is constituted by the plating layer, by forming the lower side surface 224 of the first end part 222 in an inclined manner, the fixing surface inclined with respect to the center axis can be formed.

Figure 9:
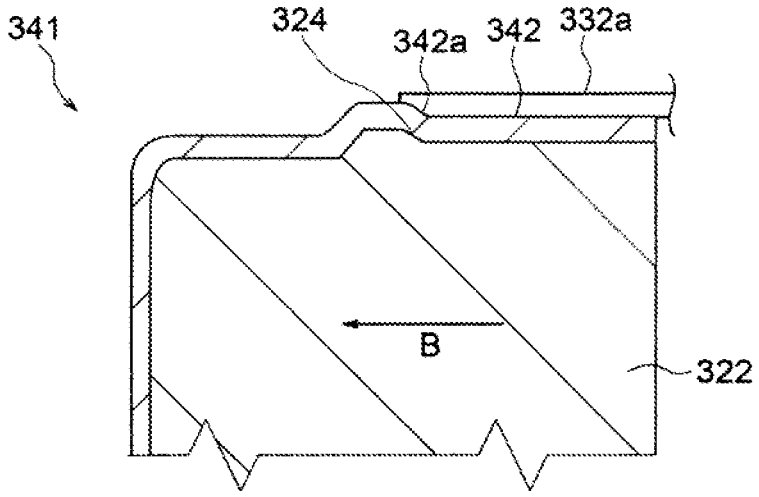
FIG. 9 is the enlarged cross section of which the surrounding of the electrode part of the coil device according to the third modified example is enlarged.

FIG. 9 is the cross section showing the first electrode part 341 included in the coil device according to the third modified example. The first electrode part 341 shown in FIG. 9 is formed at the first end part 322 of the main body core, and constituted by the paste layer made of the conductive metal such as Ag and the plating layer coating the paste layer. The first electrode part 341 formed by the paste and the plating comprises the first fixing surface 342 fixed with the wire first end part 332*a*, and a part 342*a* of the first fixing surface 342 is inclined in the direction away from the center axis with respect to the direction B. Even if the first electrode part 341 is constituted by the paste layer and the plating layer, by making a part of the lower side surface 324 of the first end part 322 inclined, the fixing surface inclined with respect to the center axis can be formed.

Note that, as the first and second electrode parts other than the metal terminal fittings, besides the above mentioned first electrode parts 241 and 341, those formed with the plating layer on the surface of the resin electrode using the mixture of Ag and the epoxy resin; and those stacking the plating layer on the spatter layer of Ni or so may be mentioned. The coil device according to such second and third modified example can also accurately control the position of cut of the wire, and the shape of the wire first end parts 232*a* and 332*a*.

NUMERICAL REFERENCES

10 . . . Coil device
16 . . . Flat plate core
20 . . . Main body core
21 . . . Axial part
22 . . . First end part
26 . . . Second end part
23, 27 . . . End surface
24, 28 . . . Lower side surface
24*a*, 28*a* . . . Projected surface
24*b*, 28*b* . . . Depressed surface
29 . . . Upper side surface
30 . . . Coil part
31, 32, 33, 34 . . . Wire
31*a*, 32*a*, 33*a*, 34*a* . . . Wire first end part
31*b*, 32*b*, 33*b*, 34*b* . . . Wire second end part
41 . . . First electrode part
42 . . . First fixing surface
51 . . . Second electrode part
52 . . . Second fixing surface
42*a* . . . Fixing end
43 . . . Inner side surface
44, 54 . . . Non-fixing surface
46, 56 . . . Extension part
A . . . Center axis
70 . . . Wire material
70*a* . . . Extra portion
80 . . . Heater chip

The invention claimed is:

1. A coil device, comprising:

a magnetic core having an axial part and a magnetic core end part connecting to said axial part; and a coil part formed by winding a wire around said axial part, and an electrode part provided to said magnetic core end part and made of a good conductor, wherein said electrode part comprises a fixing surface fixed with a wire end part of said wire, and the fixing surface is provided on a side surface which does not intersect with a center axis of said coil part at said magnetic core end part, and a part of said fixing surface is inclined to a direction away from said center axis with respect to a direction towards said magnetic core end part from said axial part, wherein said electrode part comprises a non-fixing surface, said non-fixing surface is provided at said side surface of said magnetic core end part and at a position further away than said fixing surface with respect to said axial part, and the non-fixing surface is closer to said center axis than a fixed end to which a tip of said wire end part on said fixing surface is fixed, said non-fixing surface is provided at a position further away than said fixing end on an extended line of said wire end part.

2. The coil device as set forth in claim 1, wherein said wire end part comprises an inclined tip surface of which a thickness of a perpendicular direction of said center axis becomes thinner towards the tip.

3. The coil device as set forth in claim 1 comprising at least two of said electrode parts including a first electrode part and a second electrode part, said magnetic core comprises a pair of said magnetic core end part each connecting to both ends of said axial part, at one of said magnetic core end part, said first electrode part is provided comprising a first fixing surface as said fixing surface where one of said wire end part of said wire is fixed, at other one of said magnetic core end part, said second electrode part is provided comprising a second fixing surface as said fixing surface where other one of said wire end part of said wire is fixed, and one of said side surface of said magnetic core end part provided with said first fixing surface and other one of said side surface of said magnetic core end part provided with said second fixing surface are positioned on a same plane.

4. The coil device as set forth in claim 1, wherein said electrode part is a metal terminal fitting.

5. The coil device as set forth in claim 1, wherein said electrode part is constituted by a plating layer.

6. The coil device as set forth in claim 1, wherein said electrode part is constituted by a paste layer and a plating layer.

* * * * *